US012758829B1

(12) United States Patent
McIntosh et al.

(10) Patent No.: US 12,758,829 B1
(45) Date of Patent: Oct. 13, 2026

(54) POLARIZABLE FRAME BALL

(71) Applicant: Endepium Technology, LLC, Colorado Springs, CO (US)

(72) Inventors: Nathan Duncan Philip McIntosh, Colorado Springs, CO (US); Joel Newmiller, Colorado Springs, CO (US)

(73) Assignee: Endepium Technology, LLC, Colorado Springs, CO (US)

( * ) Notice: Subject to any disclaimer, the term of this patent is extended or adjusted under 35 U.S.C. 154(b) by 0 days.

(21) Appl. No.: 18/767,562

(22) Filed: Jul. 9, 2024

Related U.S. Application Data

(60) Provisional application No. 63/525,837, filed on Jul. 10, 2023.

(51) Int. Cl.
*A63B 43/04* (2006.01)

(52) U.S. Cl.
CPC ..... *A63B 43/04* (2013.01)

(58) Field of Classification Search
CPC ..... A63B 43/04; A63B 43/002
See application file for complete search history.

(56) References Cited

U.S. PATENT DOCUMENTS

D312,102 S * 11/1990 Klitsner ..... D21/408
D318,506 S * 7/1991 Caranica ..... D21/468
D473,021 S * 4/2003 Gourley ..... D30/160
D623,247 S * 9/2010 Zawitz ..... D21/707
7,867,115 B2 * 1/2011 Zawitz ..... A63H 33/22 446/175
D651,372 S * 12/2011 Rutherford ..... D30/160
D717,521 S * 11/2014 Slusarczyk ..... D1/130
D895,819 S * 9/2020 Douglas ..... D24/195
D1,031,884 S * 6/2024 Fu ..... D21/408
2006/0280545 A1 * 12/2006 Zawitz ..... B43K 5/005 401/6
2008/0090486 A1 * 4/2008 Zawitz ..... A63H 33/18 446/124
2013/0074780 A1 * 3/2013 Wechsler ..... A01K 15/026 119/710
2015/0246266 A1 * 9/2015 Zawitz ..... A63H 33/22 473/612
2018/0221717 A1 * 8/2018 Hinnen, III ..... A63B 43/04

* cited by examiner

*Primary Examiner* — Eugene L Kim
(74) *Attorney, Agent, or Firm* — James W. Huffman; Huffman Law Group, PC

(57) ABSTRACT

The invention is a frame ball that can be polarized to preferentially land in one of three orientations. A series of hollow tubes are joined at each end by a connector that forms the tubes into an open-frame spherical shape with flattened poles. Manipulation of the material that fills the tubes allows the center of mass of the invention to be changed. By shifting the center of mass the frame ball can be biased to preferentially land on one pole more often than the other, or to not land on a pole at all. The device can be spun like a top but comes to rest only in predefined orientations.

13 Claims, 7 Drawing Sheets

POLARIZABLE FRAME BALL

FIELD OF THE INVENTION

The present invention relates to frame balls.

CROSS REFERENCE TO RELATED APPLICATIONS

This Non Provisional Application claims priority to U.S. Provisional Application Ser. No. 63/525,837, filed Jul. 10, 2023, which is incorporated by reference herein for all purposes.

BACKGROUND OF THE INVENTION AND PRIOR ART

The invention may generally be described as a frame ball. Early frame balls are those of Spencer (U.S. Pat. No. 115,252A, 1871) which describes a skeleton metallic trap ball made of wire, and Dickey (U.S. Pat. No. 513,560A, 1896) which describes a ball that consists of a series of small wires, rods or bars which are bent to approximate the form of a half circle and have their ends bent around suitable rings. Hunt (USD219284S, 1970) shows an ornamental design for a ball toy. The embodiment of Richards (U.S. Pat. No. 4,974,844A, 1989) is a ball structure utilizing a plurality of annular elements or disk-like members placed in side-by-side disposition with one another. Each of the members are constructed of soft, flexible, foam material. The invention of Willinger (U.S. Pat. No. 6,622,659B2, 2001) comprises a substantially spherical or cylindrical skeletal structure of unitary construction made of natural rubber, which is capable of rolling and bouncing. The invention of Wong (U.S. Pat. No. 7,520,830B2, 2006) is a ball with a hollow inner core filled approximately 50% or less by volume with a fluid (which can include metallic spheres), a ball shell and struts (six or more) attached to the core and connected to an inner surface of the ball in such a way so as to maintain the core at the center of the ball. A swirling motion of the fluid within the hollow inner core determines the motion of the ball and a direction of travel away from a point of contact at which a force is applied to the ball to cause it to move or change direction. Wyner et al (US20060205544A1, 2006) describe an object with a dynamically changeable configuration. The outer surface configuration and/or the weight displacement configuration can be dynamically changed to alter the characteristics of the object, which can be a toy, such as a football, baseball or flying disc. To change the weight displacement of the object, the main body includes a first chamber and a second chamber therein where fluid, such as gas or liquid, can flow there between. The positioning of the fluid within the first chamber and the second chamber is controlled by a pump and valve system. The invention of Wechler (US20150020748A1, 2014) is a toy that includes a structural configuration in which a center of gravity is displaced from a geometric center of the toy so as to provide erratic kinetic movement.

DESCRIPTION OF THE INVENTION

Figure 1:
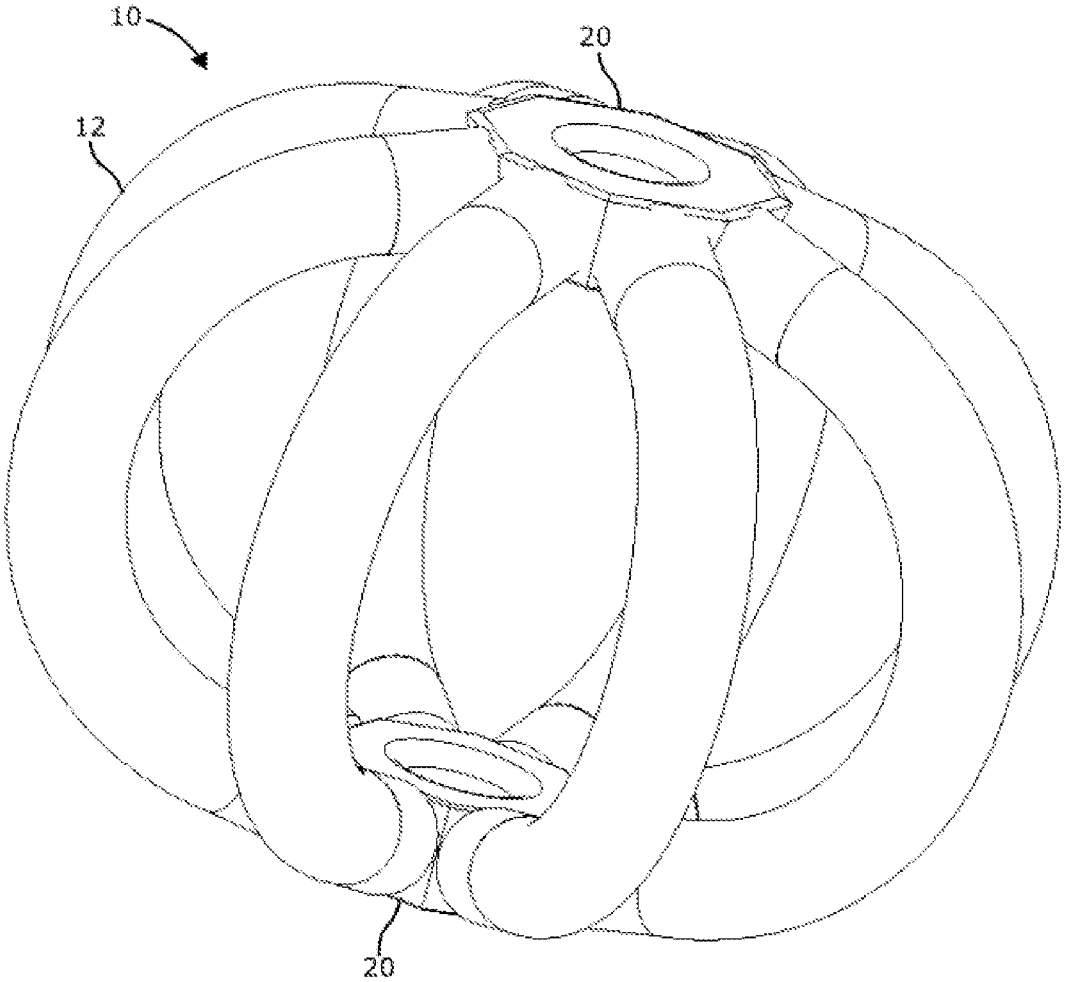
FIG. 1 illustrates the preferred embodiment of the Polarizable Frame Ball showing two pole connectors and eight tubes fully assembled.

Referring to FIG. 1, a series of hollow tubes 12 are attached at each end to a pole connector 20 (FIG. 2 and FIG. 3) to form an open-frame spherical shape 10. There may be an even or odd number of tubes and the number of tubes is such that the object readily comes to rest on one of the flats of a pole connector 20 when oriented any other way than resting on a pole connector outer flat. If initially oriented on its side with the central axis of the pole connectors horizontally aligned, the invention can be spun like a top, and will come to rest on a pole connector outer flat. As shown in FIG. 4, manipulation of the material inside the tubes allows the center of mass of the invention to be changed, thus changing the probability of landing on one flat or the other. The tubes can be transparent so that whatever is inside them can be seen, or they may be opaque so that the method of biasing the performance of the device is not visible. There is no limit to what kind of material can be inside the tubes (e.g., gravel, sand, colored beads, nuts, screws, washers, electronic components). The device can be provided as a kit, be permanently assembled to prevent modification, or it can be made to allow disassembly to alter the frequency of coming to rest on one pole or the other.

Example Embodiments

As shown in FIG. 1, the preferred embodiment 10 consists of tubes 12 and two pole connectors 20. FIG. 1 shows a device constructed with eight tubes but any number of tubes can be included so long as the device maintains an approximately spherical shape. The edge of tube 12 and the edge of pole connector 20 must be aligned so that the object easily passes over the edge of the tube to come to rest on the outer flat of the pole connector. If the edge of the tubing aligns below the edge of the pole connector, the device can come to rest at that junction and will not come to rest on the pole connector flat. There is no known size limit to the invention, but for practicality it should be sized to be easily held and transported. Tested prototypes are approximately 10-15 cm in diameter.

Another embodiment comprises eight tubes which are a mixture of balanced material, and imbalanced material. That is, some of the tubes may be extruded linearly so that all parts of the tube have a similar thickness or mass. In addition, some of the tubes may be extruded non linearly, so that one end of the tube has a greater mass than the opposite end of the tube. By mixing linear tubes with non linear tubes to form the frame ball, bias may be applied to either the first or second connector.

Figure 2:
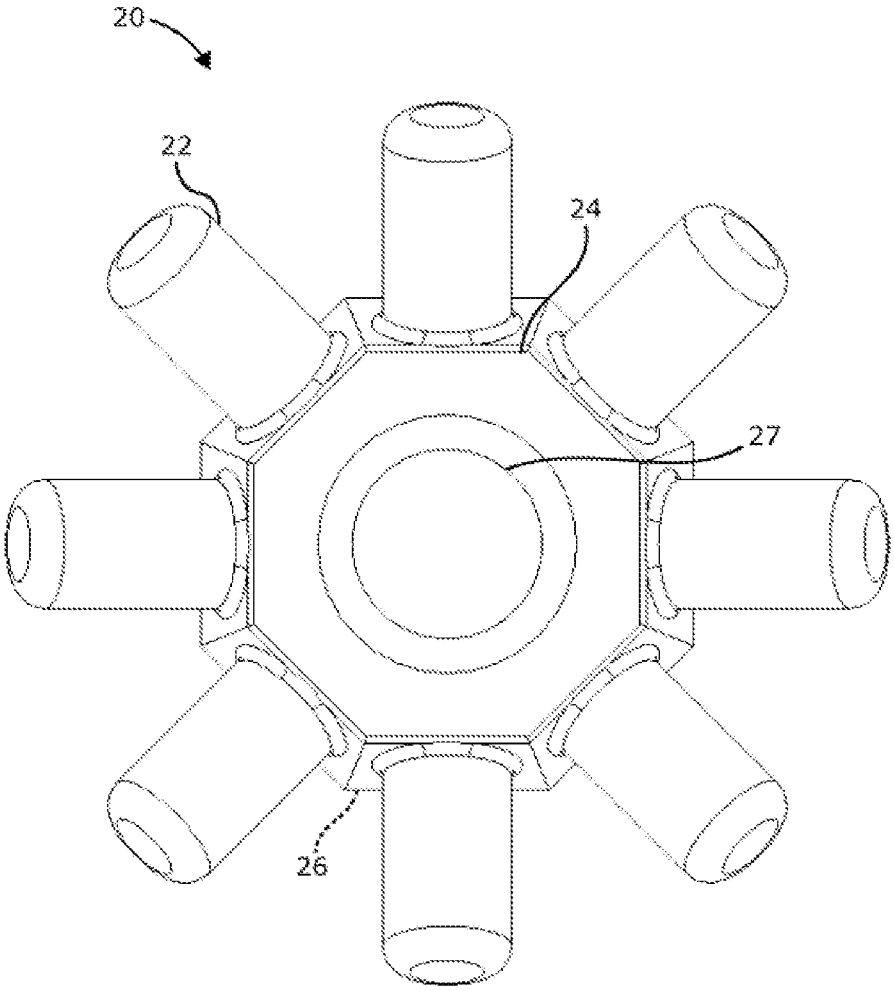
FIG. 2 illustrates a pole connector when viewed from the bottom.

FIG. 2 illustrates the pole connector 20 top view with tube connector 22, pole connector inner flat 24, and pole connector outer flat 26. Pole connector 20 has thru hole 27. The hole is not required for normal function of the device but reduces the amount of material required for fabrication. The diameter (or width if the flats are not circular) of the pole connector outer flats must be large enough so that the device rarely rolls over them to come to rest in any other position than on a flat. Irregularities on the surface on which the device is spun can affect its performance and on occasion result in a non-flat landing. The exact form of the central section from which the tube connectors extend does not matter so long as the tubes can be arranged to form an approximately spherical shape when assembled and the device reliably comes to rest on a pole connector outer flat. The outside diameter of the tube connectors is such that the tubes slide over them for installation and remain in place during use. The tubes may be fastened with an adhesive to prevent disassembly, or they may be left removable so the material inside the tubes can be changed.

Figure 3:
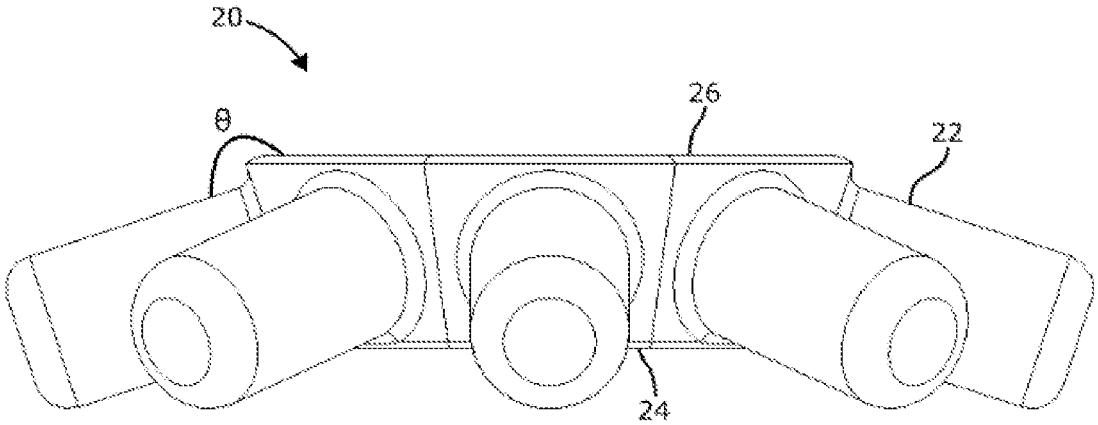
FIG. 3 illustrates a pole connector when viewed from the side.
Figure 4:
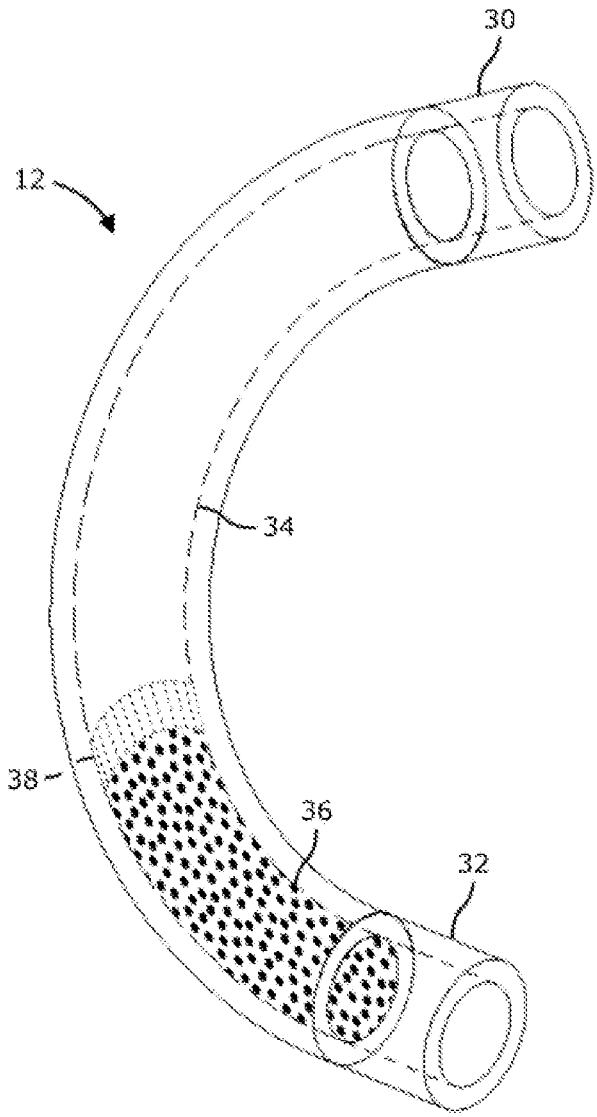
FIG. 4 shows an individual tube partially filled with a generic material to bias the landing frequency of the device.

FIG. 3 provides the pole connector side view with tube connector 22, pole connector inner flat 24, and pole connector outer flat 26. The angle between the central axes of a tube connector 22 and the pole connector outer flat 26 must be such that when the tubes are installed the invention maintains an approximately spherical shape. An angle of −15±2° allows for satisfactory performance (reliably landing on a flat >98% of the time after being spun on its side). Angles outside of this range can work if the lengths of the tubes are such that an approximately spherical shape is maintained after assembly.

A method of biasing the device by altering the density of matter in the tubes is illustrated in FIG. 4. With one end 30 of a tube 12 left open and the other open end 32 attached to a pole connector 22 to plug it, the tube internal space 34 is filled with an arbitrary quantity of filler material 36. The filler material can be anything that fits into the tube, such as gravel, sand, beads, hardware, iron filings, seeds, etc. High density material such as iron filings will have a much greater impact on biasing than less dense material such as seeds. If the tubes are transparent, the filler material can add visual interest. When the desired level of filler is in place, plug 38 is inserted to keep the filler localized to one part of the tube. The plug is conveniently made of polyurethane foam, but any plug that prevents the filler material from shifting in the tube is sufficient.

Figure 5:
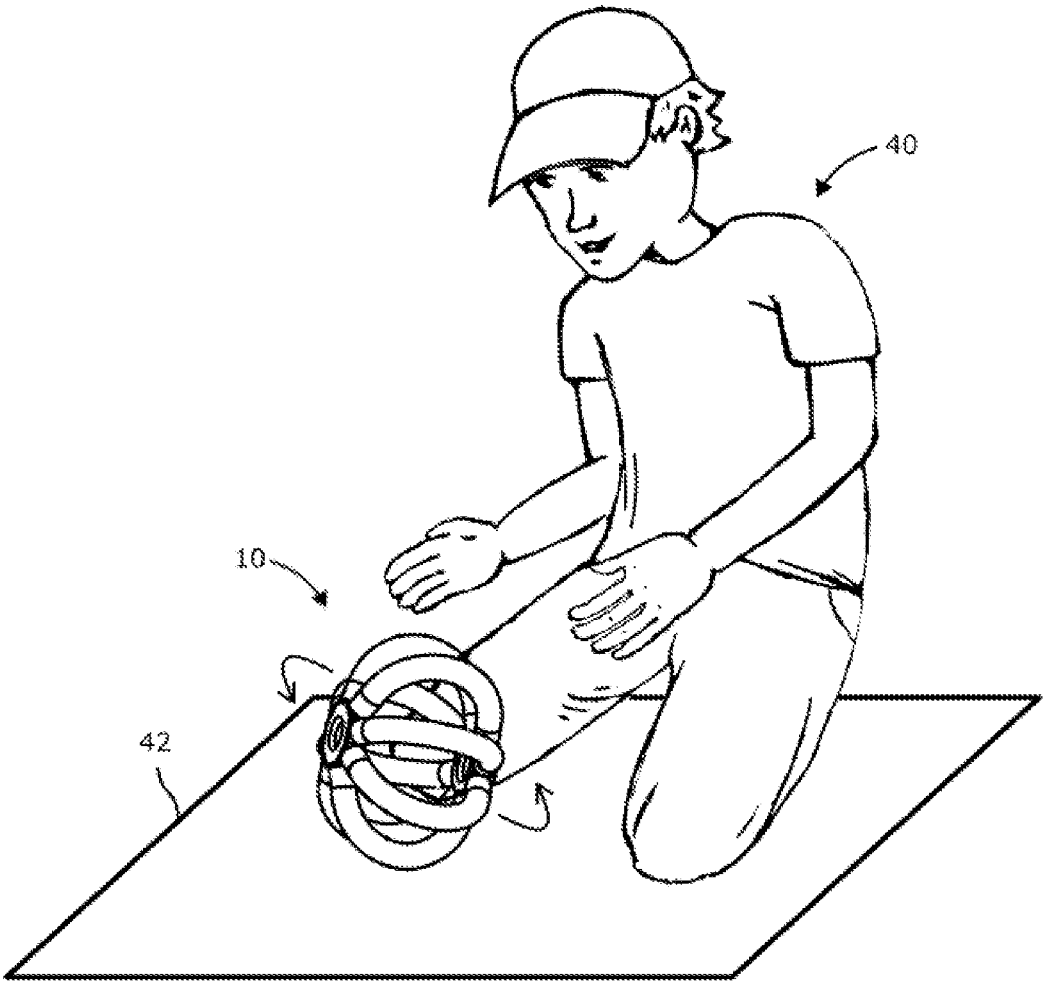
FIG. 5 shows an example of the device in use.

FIG. 5 illustrates one way to use the device. Person 40 is releasing device 10 onto floor 42 with a spinning motion.

An additional embodiment of the device uses a modified pole connector 20 with hole 27 sized to accept one end of a chemiluminescent device referred to as a "glow stick." The diameter of hole 27 can be adjusted to accommodate one end of a small glowstick of varying diameters. Unlike the pole connector used in the preferred embodiment, the bottom of hole 27 can have a small shoulder to prevent the glow stick from being pushed all the way through the connector. The diameter of hole 27 should be such that it allows one end of the glow stick to be secured in place with a slight press fit when inserted ensuring that it does not dislodge when thrown or spun. The glow stick can be easily replaced once chemiluminescence has been exhausted by pushing it out of hole 27 in the opposite direction from which it was inserted. The pole connector can be modified to accept any form factor of glow stick, and the length of tubes 12 can be made so that the glow stick spans the distance between pole connectors when assembled. The addition of the glow stick makes the device visible in the dark while leaving its basic functions unchanged.

Objects and Advantages

Many existing similar devices are designed to be soft flexible toys suitable for play by children or pets, able to return to their original shape after deformation. With the exception of that of Wyner et al, which uses a completely different mechanism, no prior art is designed to be user-modifiable after original manufacture. Previously described inventions are not designed to be disassembled by the user to change their performance, nor are they polarizable to preferentially come to rest in a specified orientation with adjustable probability.

Depending on the configuration of the tubes and what is in them, the described frame ball comes to rest in one of three possible final orientations: on a pole connector outer flat 26, the opposite pole connector outer flat 26, or it may not come to rest on a flat at all. After being spun on its side (orthogonal to central axis of the pole connectors), the device may come to rest on a flat which can be called "up" or "down," "plus" or "minus," or if the connector connectors are colored, "yellow" or "black," for example. A typical ball, open-frame such as this one or one with a continuous spherical surface, will come to rest in any number of final orientations that cannot be predicted. The device must be sufficiently rigid to resist deformation to avoid frequent non-pole landings.

Figure 6:
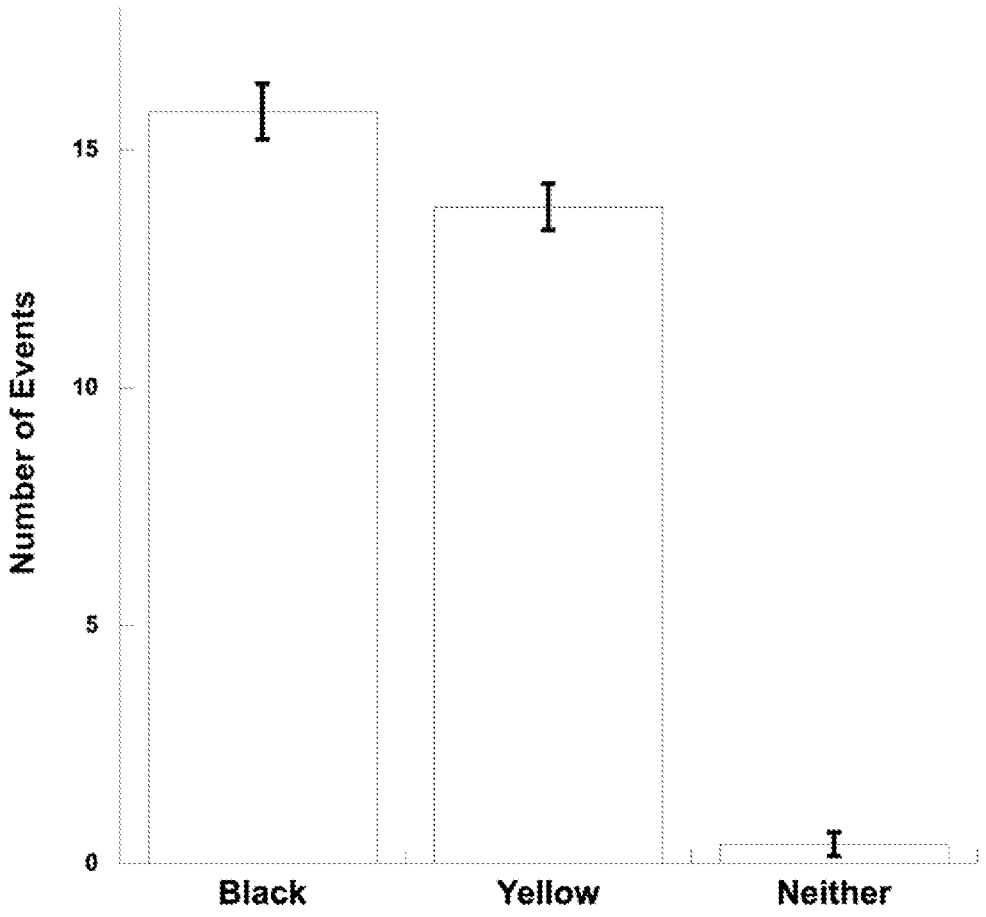
FIG. 6 is a bar graph showing the results of testing the pole landing frequency of an unbiased prototype.
Figure 7:
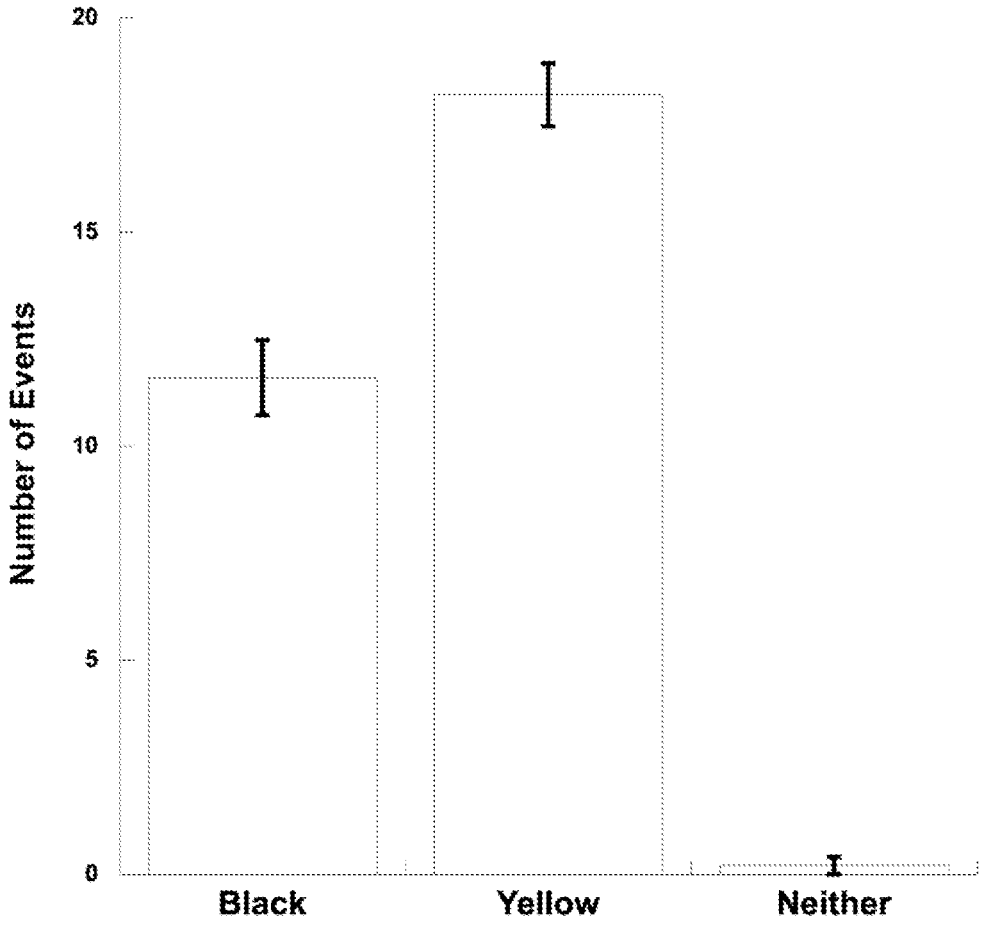
FIG. 7 is a bar graph showing the results of testing the pole landing frequency of a biased prototype.

By experimental analysis, the probability of the invention landing on one pole or the other, or not landing on a pole at all, can be determined. FIG. 6 illustrates the result of five replicates of spinning an unbiased device 30 times, recording the landing position (yellow, black, or neither) and combining results. Each bar represents the mean±standard error. The probability of the unbiased prototype landing on a given pole is close to ½ with only a small chance of not successfully coming to rest on a pole. As true for the flip of a fair coin, it is unlikely that an exact probability of ½ can ever be achieved for even a perfectly symmetrical device due to variations in the spin surface, the temperature, air resistance and other known or unknown variables. The probability of landing in a particular final orientation can be adjusted by varying the mass distribution inside the tubes. FIG. 7 shows the result of an experiment as described for an unbiased prototype with two opposed tubes filled about ⅓ full of pea gravel and retained in place with a foam plug, much like as shown in FIG. 4. Since the extra mass was added to the black pole side, more frequent landings with the yellow pole up are expected. That is what was observed with a significantly higher number of landings on yellow than black with the number of nonpolar landings unaffected. In 240 spins during the course of the experiments, the device failed to land on a pole only 1.25% of the time. The non-polar landing frequency can be increased by completely filling the tubes with matter on one side of the device, while leaving the tubes on the opposite side empty.

The device can be used as a "decision maker" (one flat "yes," the other flat "no"), or be a substitute for a coin flip (fair or unfair, depending on biasing). A person with knowledge of the probability of landing on one pole or the other would have an advantage if the device is used in a game of chance. In an educational setting, the device can be used to study experimental probability, the law of large numbers, the repeatability of applied spin forces, to analyze the friction forces between the device and various surfaces by timing how long the device spins before landing, or it can be used in a contest to see who can make it spin the longest before coming to rest. Many other uses are possible.

We claim:

1. A polarizable frame ball comprising:

at least two pole connectors;

a plurality of tubes coupled to the at least two pole connectors;

wherein at least one of the plurality of tubes is hollow;

wherein the at least one of the hollow tubes may be at least partially filled; and wherein when the at least one of the hollow tubes is partially filled, a plug is inserted to keep the filler material localized to one part of the tube.

2. The polarizable frame ball of claim 1 wherein the plurality of tubes comprises eight tubes.

3. The polarizable frame ball of claim 2 wherein the plurality of tubes are hollow.

4. The polarizable frame ball of claim 1 wherein when the plurality of tubes and the pole connectors are coupled, they form an open frame spherical shape.

5. The polarizable frame ball of claim 1 wherein the pole connectors are approximately flat on at least their outer side.

6. The polarizable frame ball of claim 1 wherein the plurality of tubes are transparent so that whatever is inside them can be seen.

7. The polarizable frame ball of claim 1 wherein by partially filling the at least one of the hollow tubes with a material, the frame ball may be biased to land on a specific one of the at least two pole connectors.

8. The polarizable frame ball of claim 7 wherein the material comprises one of sand, gravel, or beads.

9. The polarizable frame ball of claim 1 wherein the plug comprises polyurethane foam which is inserted into the at least one of the hollow tubes to prevent the filler material from shifting inside the tube.

10. A frame ball, comprising:

a plurality of hollow tubes, each of the plurality of hollow tubes having a first end and a second end;

a first connector, for connecting to the first end of the plurality of hollow tubes; and a second connector, for connecting to the second end of the plurality of hollow tubes;

wherein both the first and second connectors have a surface which allows the frame ball to rest thereon; and filler material, for placement inside one or more of the plurality of hollow tubes resulting in unequal distribution of mass affecting the preferred orientation when coming to rest after spinning;

wherein for each tube of the one or more of the plurality of hollow tubes inside which filler material is placed, a plug is inserted to keep the filler material localized to one part of the tube.

11. The frame ball of claim 10, wherein the ball can be placed on its side at a right angle with respect to the first and second connectors, and spun.

12. The frame ball of claim 11 wherein a length of the plurality of hollow tubes and an angle of joining the tubes with the first and second connectors are such that the frame ball comes to rest on an outside of the first connector, or an outside of the second connector, depending on how the filler material is distributed.

13. The frame ball of claim 10 wherein the frequency of coming to rest on the first connector or the second connector is adjusted by changing the distribution of filler material inside the plurality of tubes.

* * * * *